United States Patent [19]

Natale et al.

[11] Patent Number: 4,884,374

[45] Date of Patent: Dec. 5, 1989

[54] ASBESTOS REMOVAL GLOVE

[75] Inventors: Anthony Natale, Mt. Holly; Thomas Natale, Moorestown, both of N.J.

[73] Assignee: GPAC, Inc., Maple Shade, N.J.

[21] Appl. No.: 103,150

[22] Filed: Oct. 1, 1987

[51] Int. Cl.[4] ..... B24D 15/04

[52] U.S. Cl. ..... 51/391; 15/227; 2/161 R; 2/168

[58] Field of Search ..... 51/358, 391, 392, 394, 51/401; 15/227; 2/158, 159, 161 R, 164, 168

[56] References Cited

U.S. PATENT DOCUMENTS

| | | | |
|---|---|---|---|
| 217,818 | 7/1879 | Price | 2/161 R X |
| 251,571 | 12/1881 | Glidden | 2/161 R X |
| 277,173 | 5/1883 | Thompson | 2/161 R |
| 1,250,150 | 12/1917 | Du Bois . | |
| 1,403,817 | 1/1922 | Pinson . | |
| 2,034,169 | 3/1936 | Alefantis | 15/227 |
| 2,103,455 | 12/1937 | Greenwald | 15/227 |
| 2,550,092 | 4/1951 | Sitek | 15/227 |
| 3,557,496 | 1/1971 | Martin | 51/391 X |
| 3,750,348 | 8/1973 | Johnson | 51/391 |
| 4,107,840 | 8/1978 | Kupperman et al. | 51/391 X |
| 4,441,213 | 4/1984 | Trumble et al. | 2/168 X |
| 4,534,066 | 8/1985 | Hansson | 2/158 X |
| 4,604,111 | 8/1986 | Natale | 55/97 |
| 4,626,291 | 12/1986 | Natale | 134/21 |
| 4,670,930 | 6/1987 | Lu | 15/227 X |
| 4,752,973 | 6/1988 | Wolfberg et al. | 2/158 X |
| 4,766,914 | 8/1988 | Briggs | 2/159 X |

*Primary Examiner*—Robert P. Olszewski

*Attorney, Agent, or Firm*—Fleit, Jacobson, Cohn, Price, Holman & Stern

[57] ABSTRACT

An improved glove/mitten has been developed which includes steel needles projecting from one side of the glove/mitten to ensure complete removal of asbestos-containing materials from complex structures. The glove/mitten is bendable to adapt itself to the shape of the structure from which the asbestos-containing material is to be removed.

5 Claims, 3 Drawing Sheets

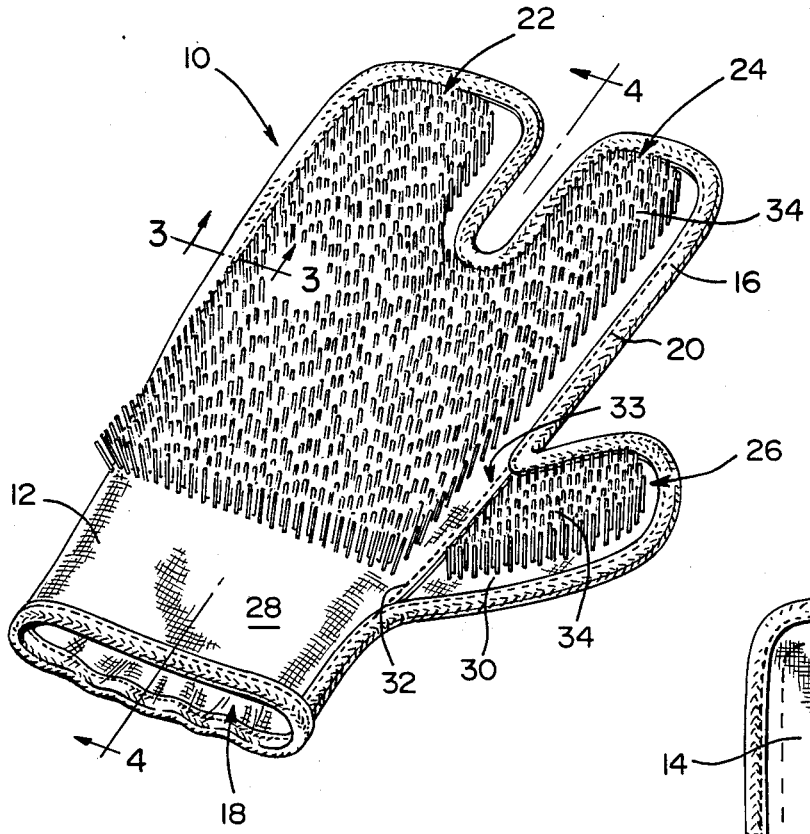
FIG. 1
FIG. 2
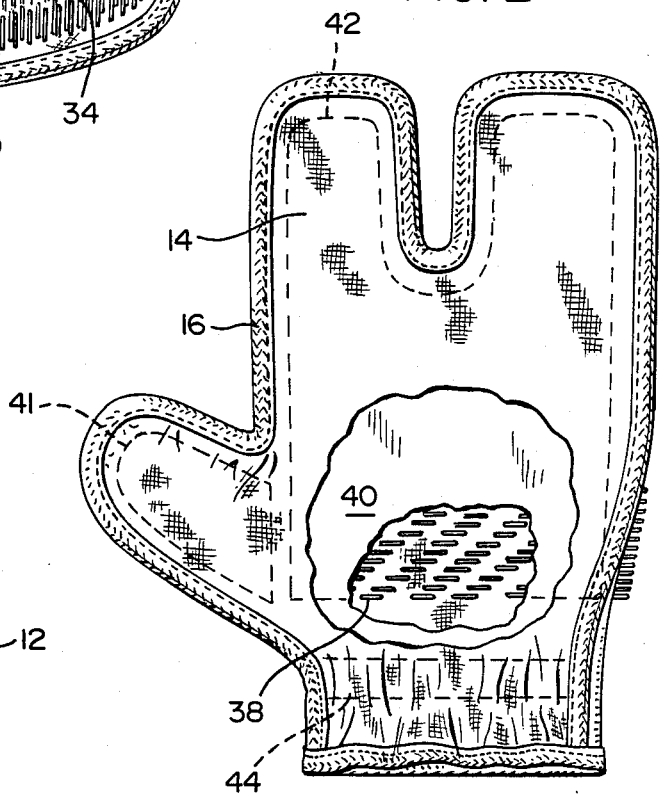
FIG. 3
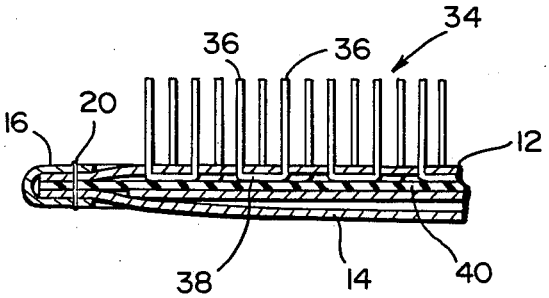
FIG. 4
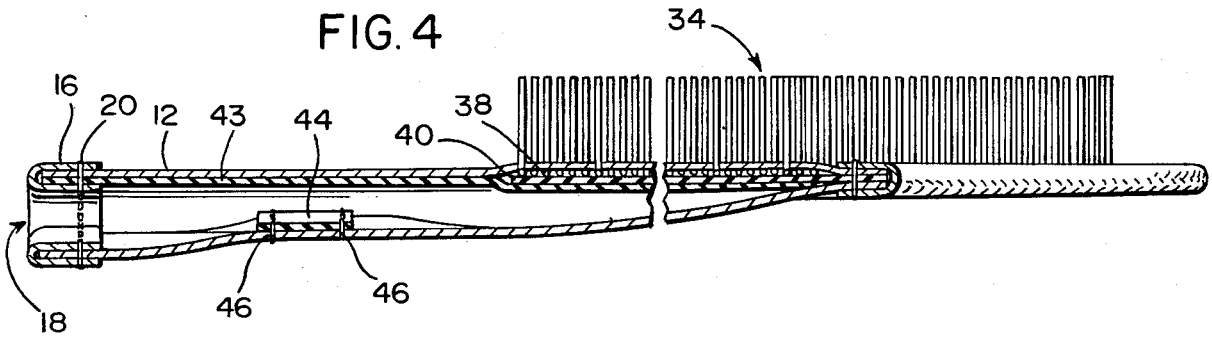

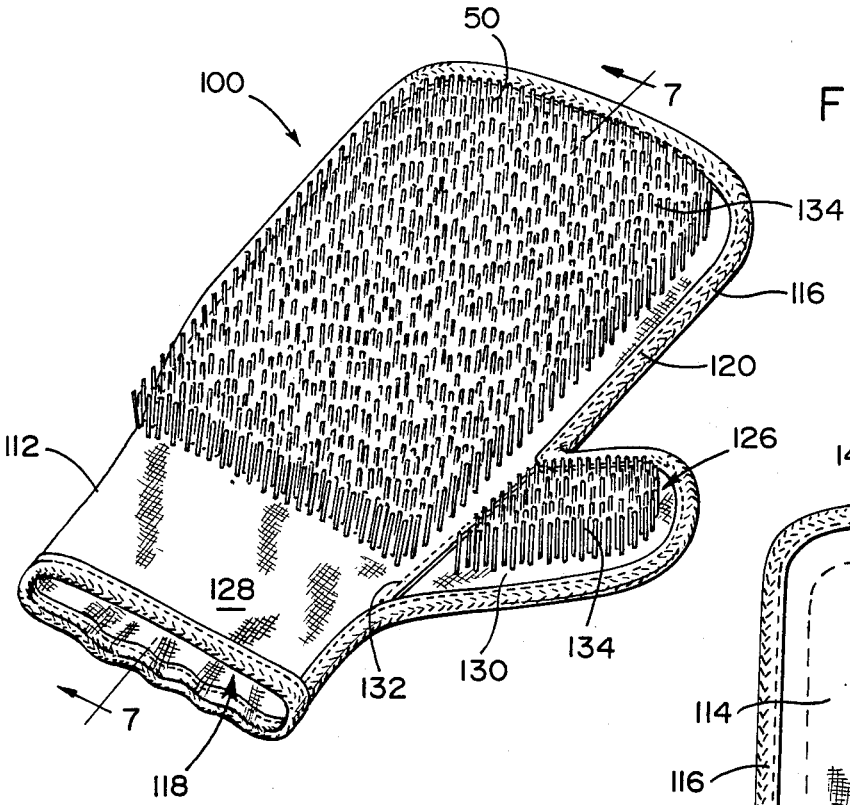
FIG. 5
FIG. 6
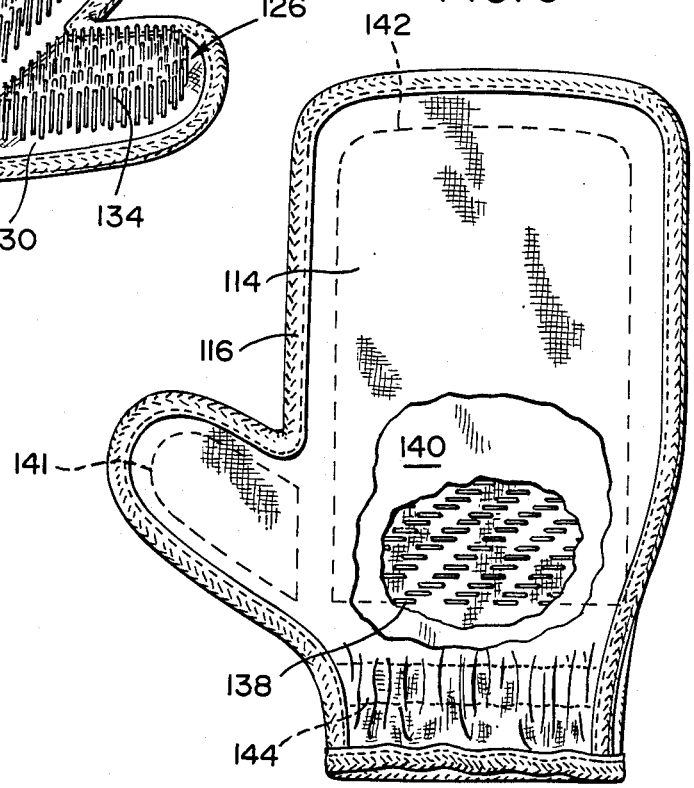
FIG. 7
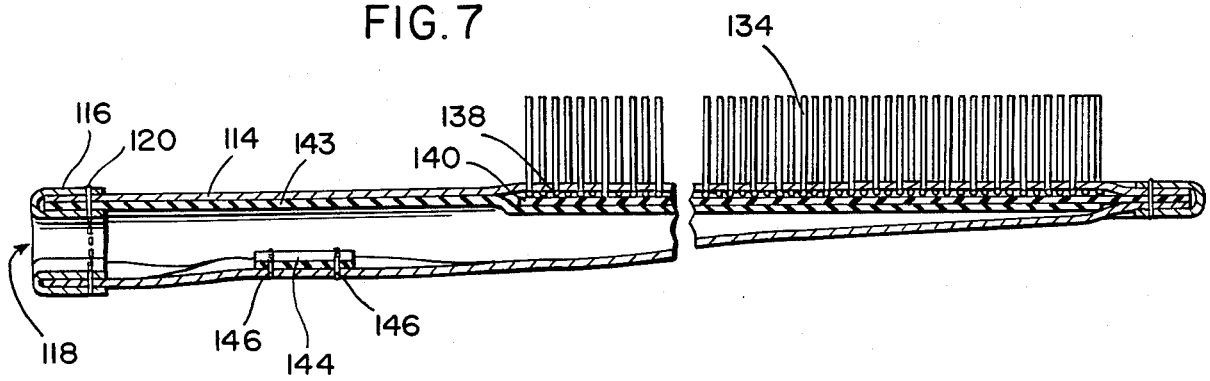

ASBESTOS REMOVAL GLOVE

BACKGROUND OF THE INVENTION

Asbestos-containing insulation on pipes, bar joists, valves, and other complex or irregular structures takes many forms, including chalky mixtures of magnesia and asbestos, preformed fibrous asbestos wrapping, asbestos fiber felt, corrogated paper, and insulating cement. In most cases, the insulating material is covered with a protective jacket (lagging) made of cloth, tape, paper, metal, or cement. Occasionally, asbestos millboard is used as outside lagging on removable insulating covers for stiffness. Lagging on pipes and boilers prevents spontaneous fiber release and helps protect against disturbance.

Removal of this asbestos-containing material has included the use of flat scrapers and wire brushes. This procedure has been found to be time-consuming and ineffective in thoroughly removing asbestos-containing material from complex and irregular structures because it is sometimes very difficult to access hard-to-reach portions of the irregular surface. Further, even with conventional surfaces, such as pipe and the like, conventional tools are often time-consuming and tiring for the operator because it is sometimes difficult to apply the scraping tool to the asbestos-covered surface.

When damage occurs to asbestos insulation and lagging on pipes and valves, removal of the material is essential in order to avoid the health hazard from potential contamination of the surrounding air by airborne asbestos fibers. To avoid exposure to airborne asbestos during asbestos removal operations, isolation protection systems, such as those disclosed in U.S. Pat. No. 4,626,291, entitled "Portable Containment Device for Treatment of Hazardous Materials", and U.S. Pat. No. 4,604,111, entitled "Particulate Contamination Control Method and Filtration Device", are used.

SUMMARY OF THE INVENTION

An improved glove/mitten has been developed which includes high-tensile carbon steel needles projecting from one side of the glove/mitten to assist in the complete removal of asbestos-containing materials from irregular structures. The glove/mitten is bendable to adapt itself to the shape of the structure from which the asbestos-containing material is to be removed.

It is an object of this invention to provide a removal device for scraping asbestos-containing materials from pipes, bar joists, valves, and other complex structures.

It is another object of the present invention to provide a flexible glove/mitten including a plurality of steel needles used to scrape asbestos-containing material from complex structures.

It is a further object of this invention to provide a glove/mitten having one surface with a density of steel needles on the order of 80 to 120 needles per square inch, preferably 100 needles per square inch.

Yet a further object of this invention is preferably to properly insulate the glove/mitten to prevent shock to the wearer in the event electrical conductors are inadvertently contacted by the steel needles.

These and other objects of the invention, as well as many of the intended advantages thereof, will become more readily apparent when reference is made to the following description, taken in conjunction with the accompanying drawings.

BRIEF DESCRIPTION OF THE DRAWINGS

FIG. 1 is a perspective view of an asbestos removal glove.

FIG. 2 is a bottom, partial sectional view of the glove shown in FIG. 1.

FIG. 3 is a partial sectional view of the glove taken along line 3—3 of FIG. 1.

FIG. 4 is a longitudinal section taken along line 4—4 of FIG. 1.

FIG. 5 is a perspective view of an asbestos removal mitten.

FIG. 6 is a bottom, partial sectional view of the mitten shown in FIG. 5.

FIG. 7 is a longitudinal section taken along the line 7—7 of FIG. 5.

DETAILED DESCRIPTION OF THE PREFERRED EMBODIMENTS

Figure 8:
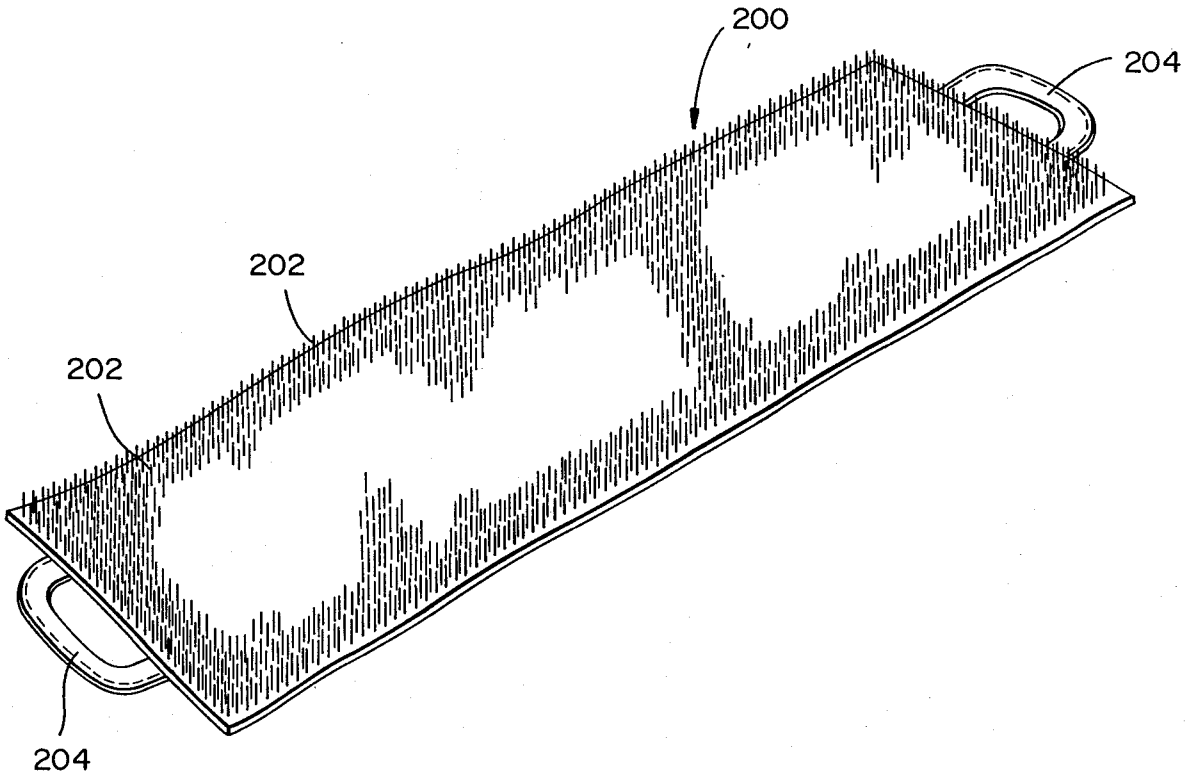
FIG. 8 is a perspective view of a cloth scraping device.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to the drawings in general, and to FIGS. 1 through 4 in particular, an asbestos removal glove embodying the teachings of the subject invention is generally designated as 10. Glove 10 is sized to fit the hand of an asbestos removal operator. It is envisioned as being within the scope of the invention that a left-hand glove would be made incorporating all of the elements disclosed and discussed for the right-hand glove and mitten shown.

Glove 10 includes two side fabric surfaces 12 and 14. Interconnecting the side surfaces 12 and 14 is cloth piping 16, which surrounds the periphery of the two side surfaces at all points except at an opening 18 defined between the two side surfaces 12 and 14 for entrance of the hand of an operator. At opening 18, the piping is folded around each side surface. The piping 16 is stitched with thread 20 to secure the two side surfaces together at all points except at opening 18.

In the preferred form of the glove shown in FIGS. 1 through 4, there is an enclosed area 26 formed between the side surfaces 12 and 14 for receipt of the thumb of an operator, enclosed area 24 formed between the side surfaces 12 and 14 for receipt of the index finger, and enclosed area 22 formed between the side surfaces 12 and 14 for receipt of the three other fingers.

In FIG. 1, the side surface 12 is shown formed of two portions 28 and 30, which are stitched to each other by thread 32 forming a seam 33. It is also contemplated within the scope of the invention that side surface 12 may be made of a single piece of fabric.

Projecting from surface 12 in both fabric portions 28 and 30 are a plurality of steel needles 34. The needles are formed by the legs of U-shaped stables, with the legs 36 of each staple passing upwards through side surface 12 and projecting away from side surface 12 for approximately 0.5 inches. The cross-piece 38, which interconnects legs 36, is located on an inside surface of fabric side surface 12. The needles are a high-tensile carbon steel with a preferred diameter of 0.02 inches.

The cross-pieces 38 are secured in place by positioning the cross-pieces 38 between side surface 12 and insulating sheet 40. Insulating sheet 40 is of the same overall configuration as the areas with needles on side surface 12. Insulating sheet 40 is made of styrene butadiene rubber or other similar flexible, electrically insulating material, such as rubber, semi-hard plastic, or other flexible insulator. Sheet 40 isolates the hand of the operator from coming in contact with the steel needles 34 to prevent the transfer of an electrical shock in the event of contact by the needles with a source of electric current.

In FIG. 2, dotted lines 41 and 42 illustrate the area of opposite surface 12, which includes a plurality of needles 34 and insulating sheet 40. Cross-pieces 38 are shown in a partly broken-away view, with insulating layer 40 also shown in a partly broken-away view. The side surface 12 is reinforced by the insulating sheet 40 at the location where needles are present to hold the cross-pieces of the needles substantially parallel to side surface 12. The side surface 12 and insulating sheet are further reinforced by a cotton and latex backing sheet 43, which is secured to the insulating sheet and the exposed inner portions of side surface 12 to form a smooth interior surface for the glove.

The rear surface 14 is formed of a single piece of fabric. Stitched across the wrist area of the surface 14 is an elastic band 44, which is shown in phantom in FIG. 2. In FIG. 4, elastic band 44 is shown stitched by threads 46 onto the interior surface of rear surface 14. The elastic band serves to gather the wrist portion of rear surface 14. When an operator's hand is inserted into the glove 10, the elastic band serves to hold the glove in position on the operator's hand.

Needles 34 project from front surface 12, which a density of between about 80 to about 120 needles per square inch, preferably about 100 needles per square inch. The needles have the characteristics of a diameter preferably 0.02 inches, length preferably 0.5 inches, and relative rigidity preferably of a tensile strength of 115–120 tons per square inch. The diameter of each needle is sufficient to strip asbestos-containing materials from a structural surface upon application of pressure by the hand of the operator which is located within the glove. The glove 10, including the insulation layer 40, is sufficiently flexible so that the plurality of needles may be positioned to adapt to the curvature or configuration of the structural member from which asbestos-containing materials are being removed.

The needles are positioned in columns and rows which are offset from one another to ensure contact with all areas of a surface as the glove is moved across the surface. The legs of a single staple are spaced approximately ¼-inch from each other. However, the legs of an adjacent staple are positioned in an adjacent column to lie between the legs of one staple and offset by a distance of about 1/16-inch. The separation between needles in adjacent rows is approximately ⅛-inch.

In FIGS. 5 through 8, an asbestos removal mitten 100 is shown. The features of the asbestos removal mitten 100 are similar to those of the asbestos removal glove, and, therefore, like features are similarly numbered in FIGS. 5 through 7 with the prefix 100.

In the asbestos removal mitten, all the fingers of the operator are located in area 50 of the mitten formed between side surfaces 112 and 114, whereas the thumb of the operator is located in area 126. Area 24 in the asbestos removal glove 10 may be used in areas of restricted access, whereas the asbestos removal mitten 100 may be used for areas of unrestricted asbestos exposure for removal.

In FIG. 8, a scraping cloth 200 is shown. Scraping cloth 200 is of similar construction as the needled portion of the glove and mitten shown in FIGS. 1 through 7. The cloth includes needles 202, projecting from a fabric backing which includes a layer of cotton fabric, a layer of insulating material, and another layer of fabric which includes a latex covering for securing the two fabric layers and the insulating material together. At opposite ends of the rectangularly shaped scraping cloth are two handles 204, which are gripped by an operator. The scraping cloth is then draped over a pipe or structural member from which asbestos is to be removed. By grabbing the two handles and causing the scraping cloth to move back and forth over the asbestos-covered surface, asbestos is effectively removed from the pipe or structural member. The details of the diameter, number, length, and rigidity for the needles 202 are the same as for the needles shown in FIGS. 1 through 7.

Having described the invention, many modifications thereto will become apparent to those skilled in the art to which it pertains without deviation from the spirit of the invention, as defined by the scope of the appended claims.

I claim:

1. An asbestos removal glove comprising:

two relatively flexible side surfaces secured to one another and defining an opening therebetween for insertion of a hand of an operator to cover the operator's fingers, thumb, and palm, a plurality of metal needles spaced along and projecting from one of said two sides surfaces in at least the palm area of said one side surface, said metal needles having a diameter and length to provide sufficient stiffness and length to strip asbestos-containing materials from structural members upon application of pressure by the hand of the operator located within the glove which structural members may include a source of electric current, and electrical insulation means located in said glove between said two side surfaces for insulating said metal needles from the hand of the operator when in the glove to prevent transfer of an electrical shock to the operator upon accidental contact by said metal needles with the source of electric current.

2. An asbestos removal glove as in claim 1, wherein two areas of said needles cover the fingers and the thumb areas of the glove.

3. An asbestos removal glove as in claim 1, wherein said electrical insulation means is a rubber sheet.

4. An asbestos removal glove as in claim 1, wherein a wrist area of the glove includes elastic means to hold the glove on the hand of the operator.

5. An asbestos removal glove as in claim 1, wherein a recess is formed in said two side surfaces to separate an area for receipt of the forefinger of the operator from an area for receipt of the remaining three fingers of the operator.

* * * * *